US012616320B2

(12) United States Patent
Jhunjhunwala

(10) Patent No.: US 12,616,320 B2
(45) Date of Patent: May 5, 2026

(54) MATTRESS COVER

(71) Applicant: Sachin Jhunjhunwala, Maharashtra (IN)

(72) Inventor: Sachin Jhunjhunwala, Maharashtra (IN)

( * ) Notice: Subject to any disclaimer, the term of this patent is extended or adjusted under 35 U.S.C. 154(b) by 0 days.

(21) Appl. No.: 18/778,119

(22) Filed: Jul. 19, 2024

(65) Prior Publication Data

US 2025/0366639 A1 Dec. 4, 2025

(30) Foreign Application Priority Data

May 30, 2024 (IN) ..... 202421042159

(51) Int. Cl.
*A47G 9/02* (2006.01)

(52) U.S. Cl.
CPC ..... *A47G 9/0246* (2013.01)

(58) Field of Classification Search
CPC ..... A47G 9/02; A47G 9/0238; A47G 9/0246; A47C 31/105
USPC ..... 5/497
See application file for complete search history.

(56) References Cited

U.S. PATENT DOCUMENTS 2,162,755 A * 6/1939 Shauer ..... A47G 9/0246 38/140
2,195,039 A * 3/1940 Shauer ..... A47G 9/0246 5/497
4,723,330 A * 2/1988 Kellogg ..... A47C 27/085 5/497
4,924,543 A * 5/1990 Hoss ..... A47G 9/02 5/490
4,980,941 A * 1/1991 Johnson, III ..... A47G 9/0246 5/497
5,029,353 A * 7/1991 Kimball ..... A47G 9/0246 5/497
5,165,128 A * 11/1992 Honig ..... A47G 9/0246 5/482
5,177,821 A * 1/1993 Kawtoski ..... A47G 9/0246 5/482
5,729,847 A * 3/1998 Allardice ..... A47G 9/02 5/500
8,813,280 B1 * 8/2014 Arora ..... A47G 9/0246 5/482
8,997,280 B1 * 4/2015 Hannula ..... A47C 31/105 5/500

(Continued)

FOREIGN PATENT DOCUMENTS

WO 2008042082 A2 4/2008

*Primary Examiner* — J. T. Newton
(74) *Attorney, Agent, or Firm* — Simpson & Simpson, PLLC

(57) ABSTRACT

A mattress cover (100) for a mattress includes a sheet (102) configured to enclose the mattress at least partially. The sheet (102) comprises an upper portion (104) to cover a top side of the mattress. Further, the sheet (102) comprises a pair of side skirt portions (106) extending from two longitudinal sides of the sheet (102), to cover two longitudinal sides of the mattress, and a pair of end skirt portions (108) extending from two transverse sides of the sheet (102), to cover two transverse sides of the mattress. A set of corner pieces (110) are stitched between the adjacent side skirt portions (106) and the end skirt portions (108-1, 108-2). The corner pieces (110) have a concave curved hypotenuse side (112).

14 Claims, 4 Drawing Sheets

(56) References Cited

U.S. PATENT DOCUMENTS

| | | | | |
|---|---|---|---|---|
| 9,259,107 | B2 * | 2/2016 | Lilienthal | A47G 9/02 |
| 9,510,698 | B1 * | 12/2016 | Krotova | A47G 9/02 |
| 10,251,498 | B1 * | 4/2019 | Feldman | A47G 9/0246 |
| 2002/0148047 | A1 * | 10/2002 | Corzani | A47C 31/105 5/699 |
| 2004/0040090 | A1 * | 3/2004 | Wootten | A47G 9/0246 5/497 |
| 2004/0163174 | A1 * | 8/2004 | Treece | A47C 27/002 5/500 |
| 2007/0056100 | A1 * | 3/2007 | Stewart | A47G 9/0246 5/497 |
| 2008/0078029 | A1 * | 4/2008 | Seago | A47G 9/0246 5/497 |
| 2012/0054962 | A1 * | 3/2012 | Agarwall | A47G 9/0246 5/497 |
| 2014/0109315 | A1 * | 4/2014 | Lilienthal | A47G 9/0246 5/497 |
| 2014/0317845 | A1 * | 10/2014 | Smith | A47G 9/0246 5/482 |

* cited by examiner

MATTRESS COVER

CROSS-REFERENCE TO RELATED APPLICATIONS

This application claims priority pursuant to 35 U.S.C. 119 (a) to Indian patent application Ser. No. 202421042159, filed May 30, 2024, which application is incorporated herein by reference in its entirety.

TECHNICAL FIELD

The present disclosure relates to the field of mattress covers. In particular, the present disclosure pertains to a mattress cover for a mattress that fits a mattress covering the sides, ends, and top of the mattress neatly and snugly and prevents the mattress cover from being easily dislodged.

BACKGROUND

Background description includes information that may be useful in understanding the present invention. It is not an admission that any of the information provided herein is prior art or relevant to the presently claimed invention, or that any publication specifically or implicitly referenced is prior art.

A mattress cover is a protective bedding item that encases or fits over a mattress, shielding the mattress from stains, spills, dust mites, and allergens. The mattress cover can be typically made of materials such as but not limited to cotton, polyester, or vinyl and can be quilted for comfort or waterproof for added protection. Using the mattress cover can prolong the life of the mattress by shielding it from damage and keeping it clean. Further, the mattress cover can also be an essential component for maintaining a hygienic sleeping environment, especially for those with allergies or asthma.

Existing mattress covers can have proper fitting issues. The existing mattress cover may shift or bunch-up during use, due to poor fitting, leading to discomfort to users and can potentially compromise the protection it offers. Further, the existing mattress covers may not be versatile enough to accommodate mattresses of different sizes or configurations. Furthermore, some of the existing mattress covers may not stretch or adjust enough to accommodate larger or smaller mattresses.

Efforts have been made in the past to improve features and design of the mattress cover to facilitate better comfort to the users. For instance, patent document WO2008/042082A2 describes a cover assembly for a mattress that includes a first cover and a second cover. The first cover includes a top panel a bottom panel, and a continuous side panel collectively defining a cavity for enclosing the mattress. The second cover includes a top surface and a bottom surface, and is positioned over and dimensionally-sized to cover at least the top panel of the first cover. A fastener connects the second cover to the first cover along the perimeter of the second cover.

However, the mattress cover disclosed in the referred document may be inefficient, due to need of extra second cover to cover the mattress. Further the referred document describes one or more zippers that extend around the perimeter of the second cover, to close the first cover and the second cover. However, frequent use and improper handling can lead to zipper damage or breakage. Further, dirt, debris, or spills may accumulate around the zipper area, requiring extra care and attention during cleaning to ensure thorough sanitation and hygiene. Furthermore, the referred mattress cover cannot be easily fitted to different sizes, and must be tailor made and specifically designed for each mattress in accordance with their size, shape, or features.

There is, therefore, a need to overcome the above-mentioned drawbacks, shortcomings, and limitations associated with the existing mattress cover, by providing a mattress cover for a mattress that can neatly and snugly cover the sides, ends, and top of the mattress and prevents the mattress cover from being dislodged from the mattress.

OBJECTS OF THE INVENTION

A general objective of the present disclosure is to provide a simple and cost-effective mattress cover for a mattress which can overcome above-mentioned limitations of the existing mattress cover.

An objective of the present disclosure is to provide a mattress cover that can allow neatly and snugly cover the sides, ends, and top of the mattress.

An objective of the present disclosure is to provide a mattress cover that can be neatly and snugly fitted to a mattress with minimal efforts.

An objective of the present disclosure is to provide a mattress cover that can prevent the mattress cover from being easily dislodged, such as during normal use.

Another objective of the present disclosure is to provide a mattress that can facilitate a tight and secure fit, thereby preventing the cover from shifting or bunching up during use.

Yet another objective of the present disclosure is to provide a mattress cover with a neat and tidy finish that can complement a bedding ensemble, thus enhancing aesthetic appeal of a bed.

Still another objective of the present disclosure is to provide a mattress cover that can fit mattresses of different thicknesses.

SUMMARY

Aspects of the present disclosure relate generally to the field of mattress covers. In particular, the present disclosure pertains to a mattress cover for a mattress that can allow neatly and snugly cover the sides, ends, and top of the mattress and prevent the mattress cover from being pulled-out from corners.

According to an aspect, the present disclosure elaborates upon a mattress cover for a mattress. The cover comprises a sheet configured to at least partially enclose the mattress. The sheet comprises an upper portion to cover a top side of the mattress. Further, the sheet comprises a pair of side skirt portions extending from two longitudinal sides of the sheet and configured to cover two longitudinal sides of the mattress. Furthermore, the sheet comprises a pair of end skirt portions extending from two transverse sides of the sheet. The pair of end skirt portions are configured to cover two transverse sides of the mattress, where adjacent side skirt portions and the end skirt portions are sewed to one other such that the sewed joints fit four corners of the mattress.

In addition, the cover comprises a set of corner pieces stitched between the adjacent side skirt portions and the end skirt portions. The set of corner pieces are stitched such that the corner pieces are parallel to the upper portion and rest, when the cover is fitted to the mattress, against a bottom side of the mattress. Furthermore, the corner pieces have a concave curved hypotenuse side.

In an aspect, the curved hypotenuse may include any of a circular, a hyperbola and a parabola shape.

In an aspect, the pair of side skirt portions and the pair of end skirt portions may be integral to the upper portion.

In an aspect, the upper portion, the pair of side skirt portions and the pair of end skirt portions may be formed by cutting square shaped pieces from four corners of a rectangular or square shaped sheet material.

In an aspect, the mattress cover may be a protective cover with the sheet having an exterior surface and an interior surface. The exterior surface may be made of hydrophilic fabric. Further, the interior surface may be made of hydrophobic fabric to resist penetration of fluid towards the surface of the mattress.

In an aspect, the mattress cover may include one or more elastic strips attached around a bottom periphery defined by the hypotenuse sides of the set corner pieces, free sides of the pair of side skirt portions and free sides of the pair of end skirt portions. The one or more elastic strips can allow the bottom periphery of the mattress cover to stretch and contract.

In an aspect, a length (l) of sides of the corner pieces may be 0.05 to 0.20 times a length of the mattress.

In an aspect, a distance of the hypotenuse side from a corresponding apex of the corner pieces may be less than a thickness of the mattress.

In an aspect, a width of the side skirt portions and the end skirt portions may be more than a thickness of the mattress such that a portion of the side skirt portions and the end skirt portions may fold over the bottom side of the mattress.

In an aspect, the hydrophobic material for the interior surface of the sheet may be selected from a group consisting of: polypropylene, polyester, nylon, acrylic, and mod acrylic.

In an aspect, the hydrophilic material for the exterior surface of the sheet may be selected from a group consisting of: cotton, wool, linen, and silk.

In an aspect, the mattress cover may be a bed sheet made of a cotton or synthetic, or a blended material.

Various objects, features, aspects, and advantages of the inventive subject matter will become more apparent from the following detailed description of preferred embodiments, along with the accompanying drawing figures in which like numerals represent like components.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION

The following is a detailed description of embodiments of the disclosure depicted in the accompanying drawings. The embodiments are in such details as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

Embodiments explained herein relate to the field of mattress covers. In particular, the present disclosure pertains to a mattress cover for a mattress that can allow neatly and snugly cover the sides, ends, and top of the mattress and prevent the mattress cover from being pulled-out from corners.

In an aspect, the present disclosure provides a mattress cover for a mattress, also known as a fitted mattress cover. The cover includes a sheet configured to at least partially enclose the mattress. The sheet comprises an upper portion to cover a top side of the mattress. Further, the sheet includes a pair of side skirt portions extending from two longitudinal sides of the sheet and configured to cover two longitudinal sides of the mattress. Furthermore, the sheet includes a pair of end skirt portions extending from two laterally disposed end sides/transverse sides of the sheet. The pair of end skirt portions are configured to cover two transverse sides of the mattress, where adjacent side skirt portions and the end skirt portions are sewed to one other such that the sewed joints fit four corners of the mattress.

In addition, the cover includes a set of corner pieces stitched between the adjacent side skirt portions and the end skirt portions. The set of corner pieces are stitched such that the corner pieces are parallel to the upper portion, and rest, when the cover is fitted to the mattress, against a bottom side of the mattress. Furthermore, the corner pieces have a concave curved hypotenuse side.

Figure 1A:
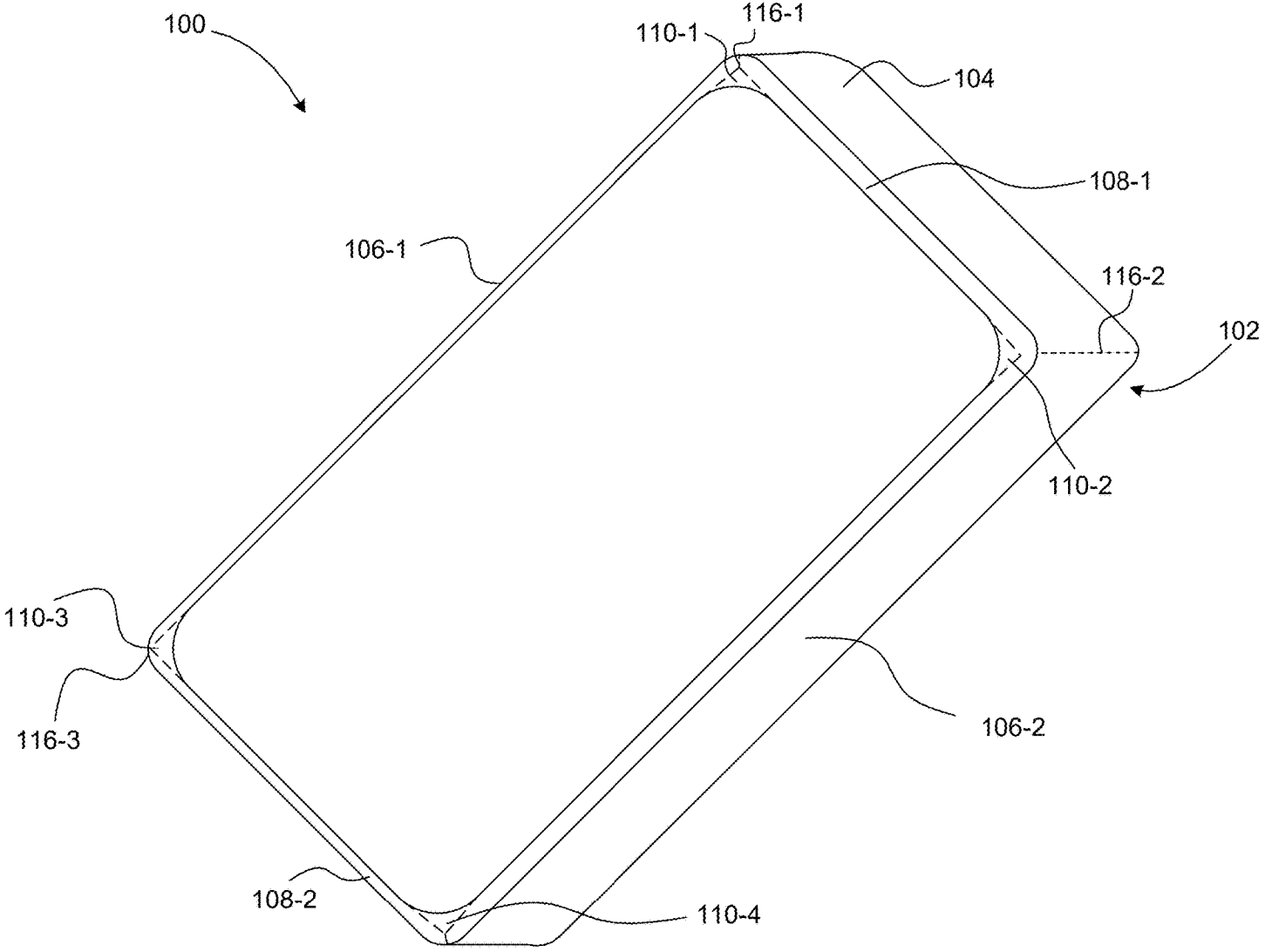
FIG. 1A illustrates an exemplary view of a proposed mattress cover showing the side skirt portions, end skirt portions and corner pieces, in accordance with an embodiment of the present disclosure.
Figure 1B:
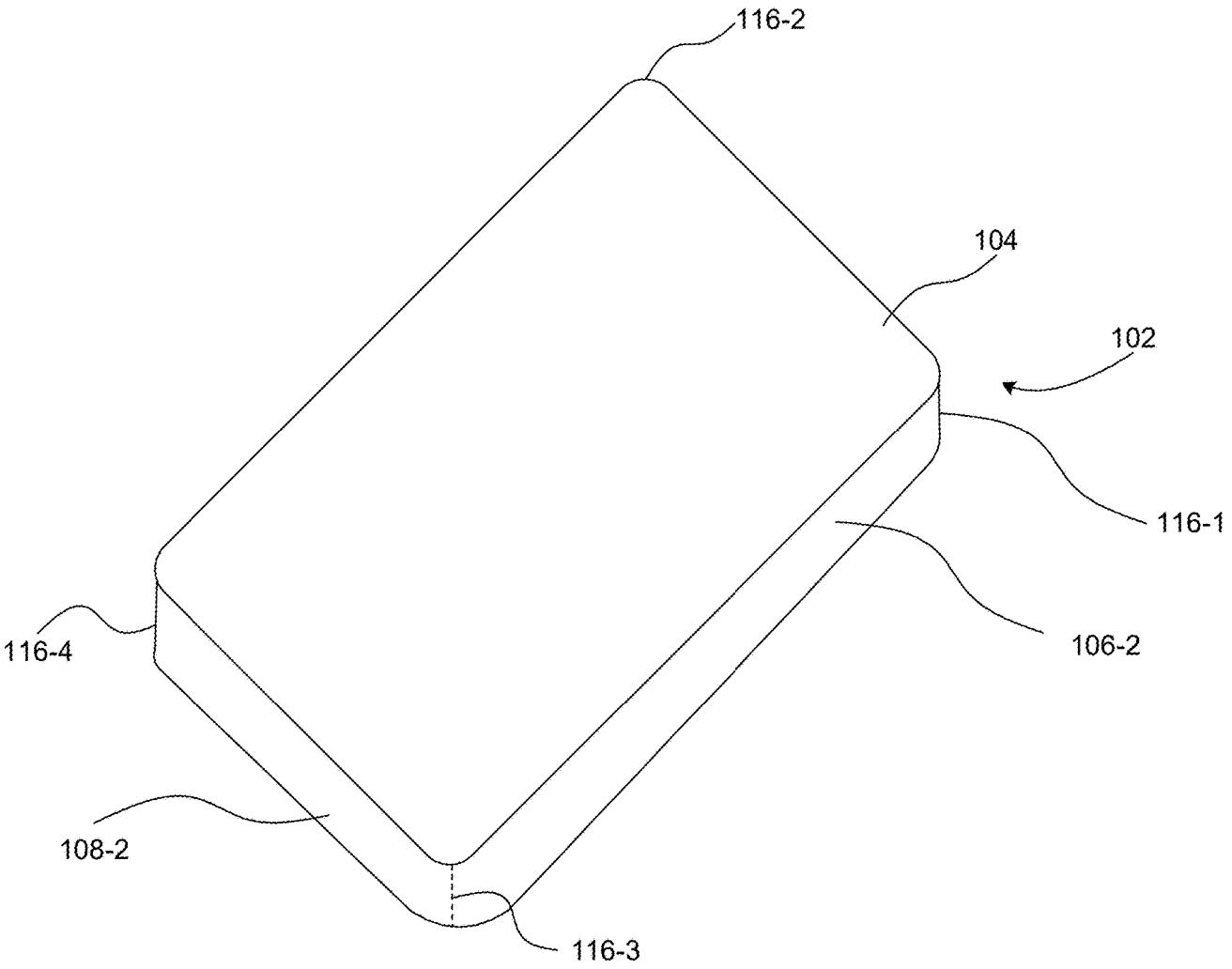
FIG. 1B illustrates an exemplary top view of the proposed mattress cover of FIG. 1A, in accordance with an embodiment of the present disclosure.
Figure 2:
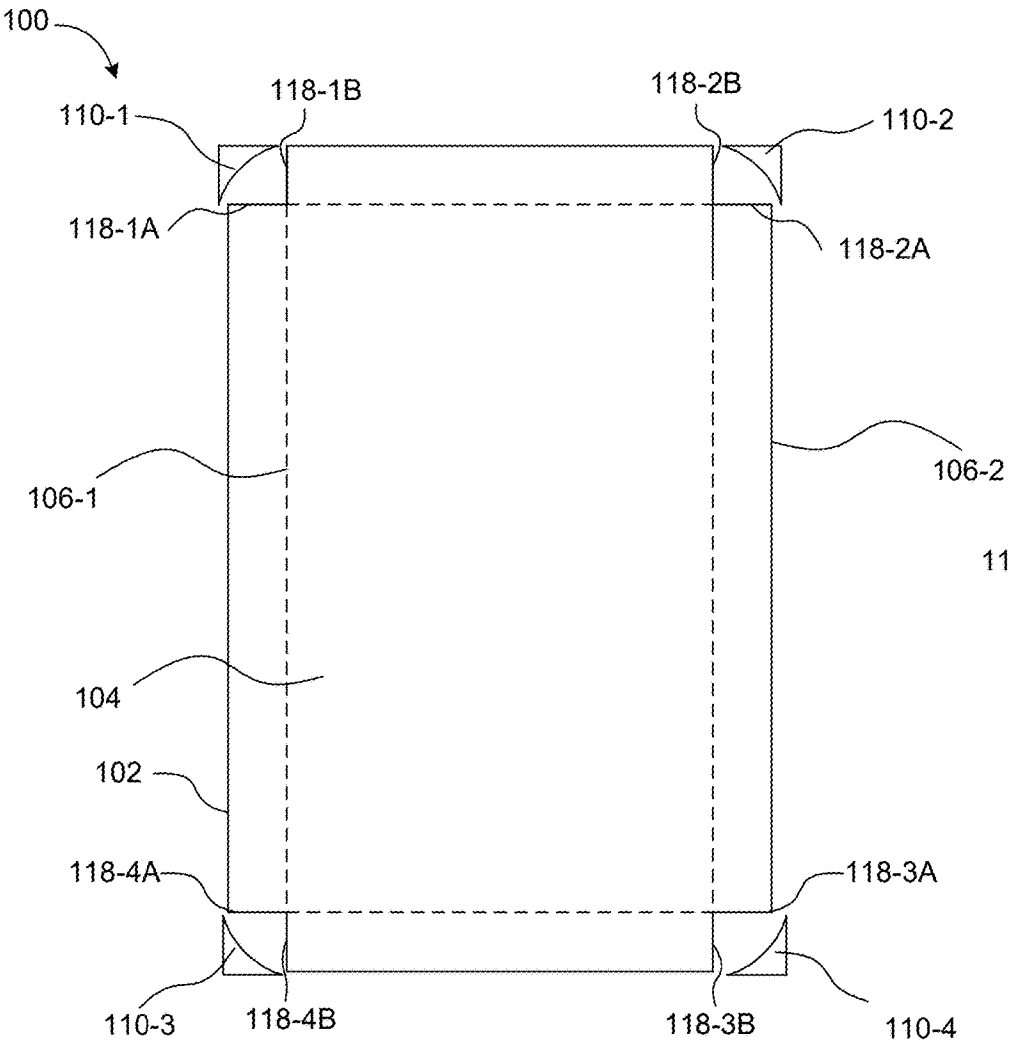
FIG. 2 illustrates an exemplary exploded view of the proposed mattress cover of FIG. 1A, showing a piece of sheet material cut to manufacture the proposed mattress cover, and corner pieces, in accordance with an embodiment of the present disclosure.

Referring to FIGS. 1A, 1B, 2 and 3, mattress cover 100 for a mattress includes sheet 102 configured to at least partially enclose the mattress. Mattress cover 100 can be a bed sheet that can be made of but not limited to a cotton or synthetic, or a blended material. As shown in FIG. 2, sheet 102 includes upper portion 104 to cover a top side of the mattress. Sheet 102 can have an exterior surface and an interior surface. When mattress cover 100 is a protective cover, the exterior surface of sheet 102 can be made of hydrophilic fabric, and the interior surface can be made of hydrophobic fabric to resist penetration of fluid towards the surface of the mattress. In an embodiment, the hydrophobic material for the interior surface of sheet 102 can be selected but not limited to from a group consisting of: polypropylene, polyester, nylon, acrylic, and mod acrylic. Further, the hydrophilic material for the exterior surface of sheet 102 can be selected from but not limited to a group consisting of: cotton, wool, linen, and silk. In different applications, sheet 102 can be entirely made of a single material, such as, but not limited to, cotton, wool, linen, and silk, without any protective inner surface.

In an embodiment, sheet 102 includes a pair of side skirt portions, such as side skirt portions 106-1, 106-2 (collectively referred to as side skirt portions 106, herein) extending from two longitudinal sides of sheet 102. Side skirt portions 106 may be configured to cover two longitudinal sides of the mattress. Further, sheet 102 includes a pair of end skirt portions 108-1, 108-2 (collectively referred to as end skirt portions 108, herein) extending from two laterally disposed end sides/transverse sides of sheet 102. The pair of end skirt portions 108 can be configured to cover two transverse sides of the mattress.

As evident from FIG. 2, the side skirt portions 106 and the end skirt portions 108 can be formed by cutting square pieces from four corners of the sheet 102 The cut corners can result in formation of corner edges, such as the corner edges 118-1A and 118-1B for the top left corner, the corner edges 118-2A and 118-2B for the top right corner, the corner edges 118-A and 118-1B for the bottom right corner, and the corner edges 118-4A and 118-4B for the bottom left corner (collectively referred to as corner edges 118, hereinafter)

In an embodiment, pairs to corner edges 118, such as 118-1A and 118-1B, of the four corners, i.e., corner edges 118, of adjacent side skirt portions 106 and end skirt portions 108 can be sewed to one other such that the sewed joints, such as sewed joints 116-1, 116-2, 116-3 and 116-4 shown in Figures, 1A and 1B, fit four corners of the mattress.

In an embodiment, while FIG. 2 shows the side skirt portions 106 and end skirt portions 108 formed by cutting off corners of sheet 102 thereby making side skirt portions 106 and end skirt portions 108 integral to the upper portion 104, i.e., the five portions fabricated from a single sheet of material, it is possible to fabricate sheet 102 by sewing side skirt portions 106 and the end skirt portions 108 cut from a different piece of fabric and sewing the separately cut side skirt portions 106 and end skirt portions 108 to upper portion 104. This gives flexibility in having upper portion 104 and skirt portions 106 & 108 of different colors, texture, material, etc.

In an embodiment, a width of side skirt portions 106 and end skirt portions 108 can be sized to be at least equal to a thickest of the mattresses with which the proposed cover 100 is to be used, such that when cover 100 is used with a mattress having a lesser thickness, a portion of side skirt portions 106 and end skirt portions 108 gets folded inwards to be positioned against the bottom side of the mattress, as shown in FIG. 1A. In an embodiment, the width of side skirt portions 106 and end skirt portions 108 can be more than the thickness of the thickest of the mattress with which cover 100 is to be used, such that a portion of side skirt portions 106 and end skirt portions 108 is always folded inwards to rest against the bottom side of the mattress.

Figure 3:
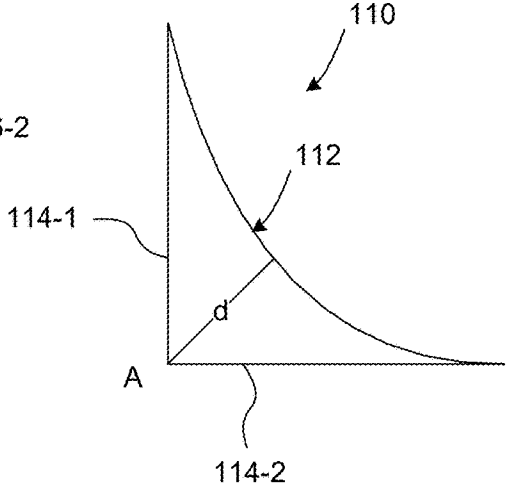
FIG. 3 illustrates an exemplary view of a corner piece with a curved hypotenuse side, in accordance with an embodiment of the present disclosure; and, FIG. 4 illustrates an exemplary view of a proposed mattress cover fitted over a thicker mattress showing that corner pieces of the mattress cover are covering the bottom corners of the thick mattress, in accordance with an embodiment of the present disclosure.

In an embodiment, mattress cover includes a set of corner pieces, such as corner pieces 110-1, 110-2, 110-3, 110-4 (individually/collectively referred to as corner piece/corner pieces 110, herein) stitched between adjacent side skirt portions 106 and end skirt portions 108. Corner pieces 110 can be parallel to the upper portion 104 and rest, when the cover 100 is fitted to the mattress, and rest against the bottom side of the mattress. In an embodiment, as shown in FIG. 3, corner pieces 110 can be generally of an isosceles triangle with a pair of perpendicular sides of equal length, such as perpendicular sides 114-1 and 114-2 (collectively referred to as sides 114, herein), and a concave curved hypotenuse side 112. Curved hypotenuse 112 can include any one of, but not limited to: a circular shape, a hyperbola shape, and a parabola shape. Further, a distance (d) of hypotenuse side 112 from a corresponding apex of corner piece 110 can be less than a thickness of the mattress, such as the thickest mattress. Furthermore, a length of sides 114 of corner pieces 110 can be 15.0 cm to 38.0 cm (6 inches to 15 inches).

In another embodiment, the length of sides 114 of the corner pieces 110 can be linked to size of the mattress, such as the length of sides 114 can be 0.05 to 20 times the length of the mattress/upper portion 104 of cover 100. The proposed size of the corner pieces shall ensure that cover 100 remains difficult to get dislodged from the mattress irrespective of the thickness of the mattress (as shown in FIGS. 1A and 1C), and yet does not pose difficulty in taking off cover 100 from the mattress.

In yet another embodiment, the lengths of two sides 114 of corner pieces 110 can be unequal, i.e., corner pieces 110 may not be an isosceles triangle, with side 114 fixed to transverse sides of sheet 102 being smaller than the side fixed to the longitudinal side of sheet 102, linked to the lengths of the respective side.

In an advantageous aspect of the present disclosure, the corner piece with curved hypotenuse side, which has a parabolic or hyperbolic shape, allows size of sides 114 to be increased without proportionate increase in the distance (d) of hypotenuse side 112 from a corresponding apex of corner piece 110, which if increased, shall make removal of cover 100 from the mattress difficult. Increase in length of sides 114 prevents unintended dislodging of the cover from underneath the mattress when the overlap of skirt portions 106, 108 with the bottom of the mattress is low. In another aspect, on account of the permissible reduced overlap of sheet skirt portions 106, 108 with the bottom of the mattress, sheet 102 can be fabricated with reduced size of fabric.

In an embodiment, one or more elastic strips can be attached around a bottom periphery defined by the hypotenuse sides 112 of the set corner pieces 110, free sides of the side skirt portions 106 and free sides of end skirt portions 108. The one or more elastic strips can allow the bottom periphery of mattress cover 100 to stretch and contract. The one or more elastic strips can be elastic bands made from a series of rubber. The rubber can be selected either from a natural rubber or a synthetic rubber. In an embodiment, the one or more elastic strips can be made from combination of materials such as but not limited to rubber, nylon, polyester and the like.

Figure 4:
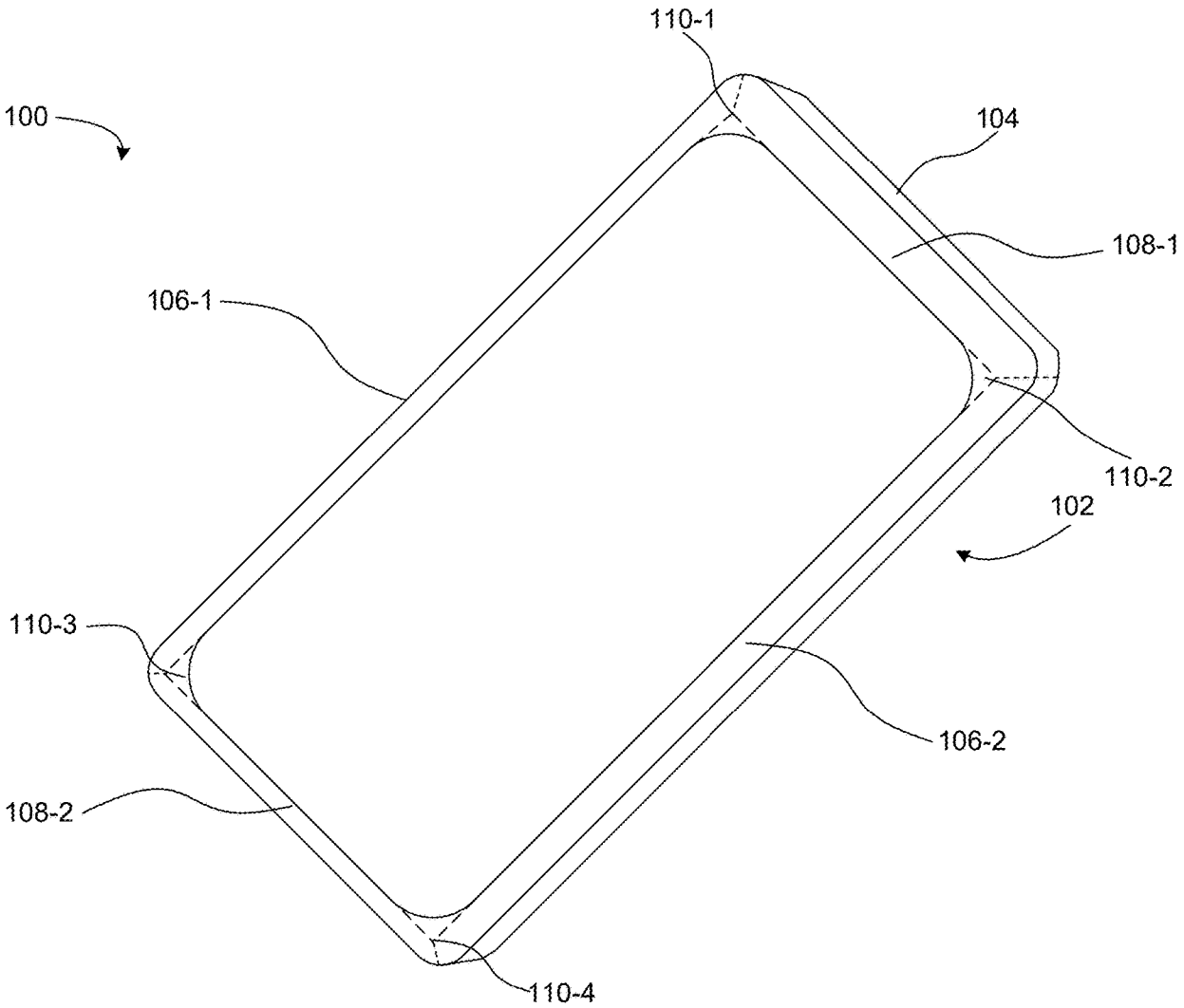

The one or more elastic strips help to pull skirt portions 106, 108 inwards, which can be especially advantageous when cover is used with a mattress having lower thickness than cover 100 is designed for. FIG. 4 shows a bottom side of the mattress fitted with cover 100, where the mattress is of lower thickness than cover 100 is designed for, showing excess skirt portions 106, 108 pulled inward by the elastic strips to keep the cover fold/wrinkle free on the top and sides of the mattress.

Thus, the present disclosure overcomes the drawbacks, shortcomings, and limitations associated with the existing mattress cover, by providing a simple, cost-effective mattress cover 100, having advantageous features. The advantageous features include corner pieces 110 have a concave curved hypotenuse side 112, to facilitate a tight and secure fit, thereby preventing the cover from shifting or bunching up during sleep. The proposed mattress cover 100 can fit over a different range of mattress sizes. Further, the proposed flexible mattress cover 100 fits over the mattress of varying thickness range.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

Advantages of the Invention

The present invention provides a simple and cost-effective mattress cover which can overcome limitations of the existing mattress cover.

The present invention provides a mattress cover that allows neatly and snugly cover the sides, ends, and top of the mattress.

The present invention provides a mattress cover that can be neatly and snugly fitted to a mattress with minimal efforts.

The present invention provides a mattress cover that can prevent the mattress cover from being easily dislodged, such as during normal use.

The present invention provides a mattress that can facilitate a tight and secure fit, thereby preventing the cover from shifting or bunching up during use.

The present invention provides a mattress cover with a neat and tidy finish that can complement a bedding ensemble, thus enhancing aesthetic appeal of a bed.

The present invention provides a mattress cover that can fit mattresses of different thicknesses.

I claim:

1. A mattress cover (100), comprising:

a sheet (102) configured to at least partially enclose the mattress, the sheet (102) comprising an upper portion (104) to cover a top side of the mattress, a pair of side skirt portions (106) extending from two longitudinal sides of the sheet (102) and configured to cover two longitudinal sides of the mattress, and a pair of end skirt portions (108) extending from two transverse sides of the sheet (102) and configured to cover two transverse sides of the mattress, wherein adjacent side skirt portions (106) and the end skirt portions (108) are sewed to one other such that the sewed joints fit four corners of the mattress; and a set of corner pieces (110) stitched between the adjacent side skirt portions (106) and the end skirt portions (108) such that the set of corner pieces (110) are parallel to the upper portion (104) and rest, when the cover is fitted to the mattress, against a bottom side of the mattress; wherein the set of corner pieces (110) are of a triangular shape with two perpendicular sides (114) and a concave curved hypotenuse side (112).

2. The mattress cover (100) as claimed in claim 1, wherein the curved hypotenuse side (112) comprises any of a circular, a hyperbola and a parabola shape.

3. The mattress cover (100) as claimed in claim 1, wherein the pair of side skirt portions (106) and the pair of end skirt portions (108) are integral to the upper portion.

4. The mattress cover (100) as claimed in claim 1, wherein the upper portion (104), the pair of side skirt portions (106) and the pair of end skirt portions (108) are formed by cutting square shaped pieces from four corners of a rectangular or square shaped sheet material.

5. The mattress cover (100) as claimed in claim 1, wherein the mattress cover (100) is a protective cover with the sheet (102) having an exterior surface and an interior surface, wherein the exterior surface is made of hydrophilic fabric, and the interior surface is made of hydrophobic fabric to resist penetration of fluid towards the surface of the mattress.

6. The mattress cover (100) as claimed in claim 1, comprising one or more elastic strips attached around a bottom periphery defined by the hypotenuse sides (112) of the set of corner pieces (110), free sides of the pair of side skirt portions (106) and free sides of the pair of end skirt portions (108-1, 108-2), where the one or more elastic strips allow the bottom periphery of the mattress cover (100) to stretch and contract.

7. The mattress cover (100) as claimed in claim 1, wherein a length (1) of sides (114) of the set of corner pieces (110) is 15.0 cm to 38.0 cm (6 inches to 15 inches).

8. The mattress cover (100) as claimed in claim 1, wherein a length (1) of sides (114) of the set of corner pieces (110) is 0.05 to 0.20 times a length of the mattress.

9. The mattress cover (100) as claimed in claim 1, wherein the corner pieces (110) have sides (114) of unequal length with the side (114) fixed to longitudinal side of the sheet (102) being bigger than the side (114) to transverse side of the sheet (102).

10. The mattress cover (100) as claimed in claim 1, wherein a distance (d) of the hypotenuse side (112) from a corresponding apex of the set of corner pieces (110) is less than a thickness of the mattress.

11. The mattress cover (100) as claimed in claim 1, wherein a width of the side skirt portions (106) and the end skirt portions (108) is more than a thickness of the mattress such that a portion of the side skirt portions (106) and the end skirt portions (108) folds over the bottom side of the mattress.

12. The mattress cover (100) as claimed in claim 5, wherein the hydrophobic material for the interior surface of the sheet (102) is selected from a group consisting of: polypropylene, polyester, nylon, acrylic, and mod acrylic.

13. The mattress cover (100) as claimed in claim 5, wherein the hydrophilic material for the exterior surface of the sheet (102) is selected from a group consisting of: cotton, wool, linen, and silk.

14. The mattress cover (100) as claimed in claim 1, wherein the mattress cover (100) is a bed sheet made of a cotton or synthetic, or a blended material.

* * * * *